US006192644B1

(12) United States Patent
Kunieda et al.

(10) Patent No.: US 6,192,644 B1
(45) Date of Patent: Feb. 27, 2001

(54) FRAME STRUCTURE AND METHOD FOR FORMING THE SAME

(75) Inventors: Haruo Kunieda, Otsu; Yoshihiro Kono, Hirakata, both of (JP)

(73) Assignee: Taiyo Kogyo Corporation, Osaka (JP)

( * ) Notice: Subject to any disclaimer, the term of this patent is extended or adjusted under 35 U.S.C. 154(b) by 0 days.

(21) Appl. No.: 09/147,124

(22) PCT Filed: May 19, 1997

(86) PCT No.: PCT/JP97/01682

§ 371 Date: Oct. 13, 1998

§ 102(e) Date: Oct. 13, 1998

(87) PCT Pub. No.: WO97/44543

PCT Pub. Date: Nov. 27, 1997

(30) Foreign Application Priority Data

| | | |
|---|---|---|
| May 22, 1996 | (JP) | 8-127276 |
| Dec. 7, 1996 | (JP) | 8-183247 |
| May 16, 1997 | (JP) | 9-126923 |

(51) Int. Cl.[7] ..... E04B 1/32; E04B 7/08

(52) U.S. Cl. ..... 52/650.3; 52/653.2; 29/897.31

(58) Field of Search ..... 52/650.3, 652.1, 52/653.1, 653.2; 29/897.31, 897.312

(56) References Cited

FOREIGN PATENT DOCUMENTS

| | | | | |
|---|---|---|---|---|
| 46-34336 | * | 10/1971 | (JP) | 52/650.3 |
| 60-188554 | * | 9/1985 | (JP) | 52/650.3 |
| 7-3890 | * | 1/1995 | (JP) | 52/650.3 |

* cited by examiner

*Primary Examiner*—Michael Safavi
(74) *Attorney, Agent, or Firm*—Arent Fox Kintner Plotkin & Kahn, PLLC

(57) ABSTRACT

A framed structure includes a plurality of base units each formed of three elongate compression members disposed so as to cross one another. Tension members are arranged to be interconnected with respective compression members forming a triangular planar units. The triangular planar units being arranged to form a self-supporting structure or base unit. A plurality of base units being interconnected in a continuous fashion such that one of the compression members in one of the base units serves as one of the compression members in an adjacent base unit.

13 Claims, 15 Drawing Sheets

FRAME STRUCTURE AND METHOD FOR FORMING THE SAME

FIELD OF THE INVENTION

This invention relates to a framed structure, and more particularly a framed structure which constitutes a framework or the like as a roofing material used for a building.

BACKGROUND OF THE INVENTION

Conventionally, as a framed structure of this type, for example, there exists the one which includes numbers of compression members made of pipe which are continuously disposed via joint members in three dimensions. Such framed structure is used as a framework or the like for a membrane structure.

However, the framed structure of this type requires numbers of the compression members. This involves problems that the total weight of the framed structure is increased, a large scaled associated structures for supporting the framed structure is required, and the cost for constructing the framed structure is increased.

To reduce the number of the compression members in view of the above, there have been recently developed a framed structure, in which tension members such as cables are tensioned between the compression members as a substitute for some parts of the compression members. However, the reduction of the weight and construction cost are still desired even in the framed structure of this type.

SUMMARY OF THE INVENTION

Therefore, the present invention has been made to solve the above problems which are inherent to the conventional structure. It is an object of the present invention is to provide a framed structure, which has a light weight and can contribute to the cost reduction.

The means which the present invention has employed to solve the above problems is the framed structure which includes a plurality of base units each including in turn three elongate compression members disposed so as to intersect one another, each having a first end and a second end, a first tension member disposed to be tensioned between the first ends of the respective compression members in such a manner as to form a first triangular plane, a second tension member disposed so as to be tensioned between the second ends of the respective compression members in such a manner as to form a second triangular plane opposite to the first triangular plane, and a third tension member disposed so as to be tensioned between the first end of one of the compression members and the second end of one of the remaining compression members in such a manner as to form a self-supporting structure, wherein the plurality of the base units are continuously disposed by using one of the compression members in one of the base units as one of the compressed members of an adjacent base unit.

Each of the base units may be formed of four compression members. In addition, a framed structure may be formed by continuously disposing the base units in a curved surface.

A method of constructing a framed structure in accordance with the present invention is characterized by the step of continuously disposing a plurality of base units by using one of compression members of one of the base units as one of the compressed members of an adjacent base unit, each of the base units including three elongate compression members disposed so as to intersect one another, each having a first end and a second end, a first tension member disposed to be tensioned between the first ends of the respective compression members in such a manner as to form a first triangular plane, a second tension member disposed so as to be tensioned between the second ends of the respective compression members in such a manner as to form a second triangular plane opposite to the first triangular plane, and a third tension member disposed so as to be tensioned between the first end of one of the compression members and the second end of one of the remaining compression members in such a manner as to form a self-supporting structure, and the step of applying tension force over at least one of the first, second and third tension members to change the shape of each of the base units, thereby forming the framed structure into a curved surface.

This method may be applied to a case where four compression members are used.

In accordance with the above arrangement, since one of the compression members also serves as one of a different base unit, it is possible to greatly reduce the number of the compression members. Accordingly, there have been produced remarkable effects that the reduction of the total weight of the framed structure can be attempted, and the arrangement contributes greatly to the reduction of the cost.

There is also provided a practical effect that, since the framed structure in accordance with the present invention is of a very simple arrangement, it can be constructed in a simple manner.

There is further provided a peculiar effect that, since the base units each are of an arrangement that the tension members are respectively tensioned between the compression members, the disposed positions among the respective compression members can properly be varied in accordance with the value of the applied tension force by the tension members, thereby forming the framed structure of the curved surface.

DETAILED DESCRIPTION OF THE PREFERRED EMBODIMENTS

An embodiment of the present invention will be described in accordance with the drawings.

First Embodiment

Figure 1:
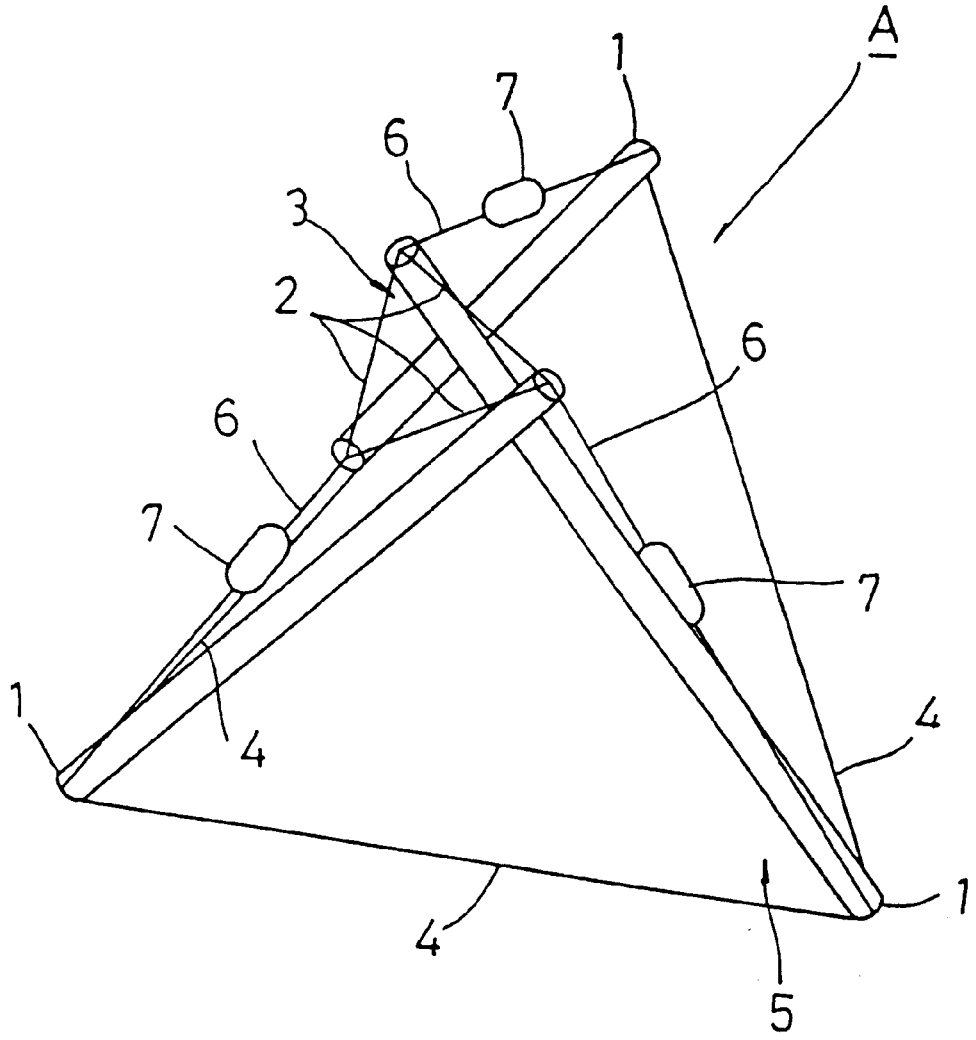
FIG. 1 is a perspective view illustrating a base unit in accordance with one embodiment of the present invention.

In FIG. 1, a reference numeral 1 designates three elongate compression members, each of which being made of a pipe, having a first end and a second end, and having a uniform length are disposed to intersect one another at predetermined angles. A reference numeral 2 designates first tension members respectively tensioned between the first ends of the compression members 1 to form a first triangular plane 3. A reference numeral 4 designates second tension members respectively tensioned between the second ends of the compression members 1 to form a second triangular plane 5 which is opposite to the first triangular plane 3. A reference numeral 6 designates third tension members 6 respectively tensioned between the first end of each compression member 1 and the second end of the remaining compression members 1 to form a self-supporting structure, and each of the third tension members 6 is provided at its substantial midpoint with a turnbuckle 7. The first, second and third tension members 2, 4 and 6 are respectively made of cables or the like, and tensioned between the respective ends of the compression members 1 by inserting the respective ends of the tension members into the respective ends of the compression members 1 and fixing the same to the insides of the pipes.

The thus formed base unit A is structurally stabilized by applying tension force over the tension members 2, 4 and 6 and compression force over the compression members 1 via the turnbuckles 7 of the third tension member 3.

Figure 2:
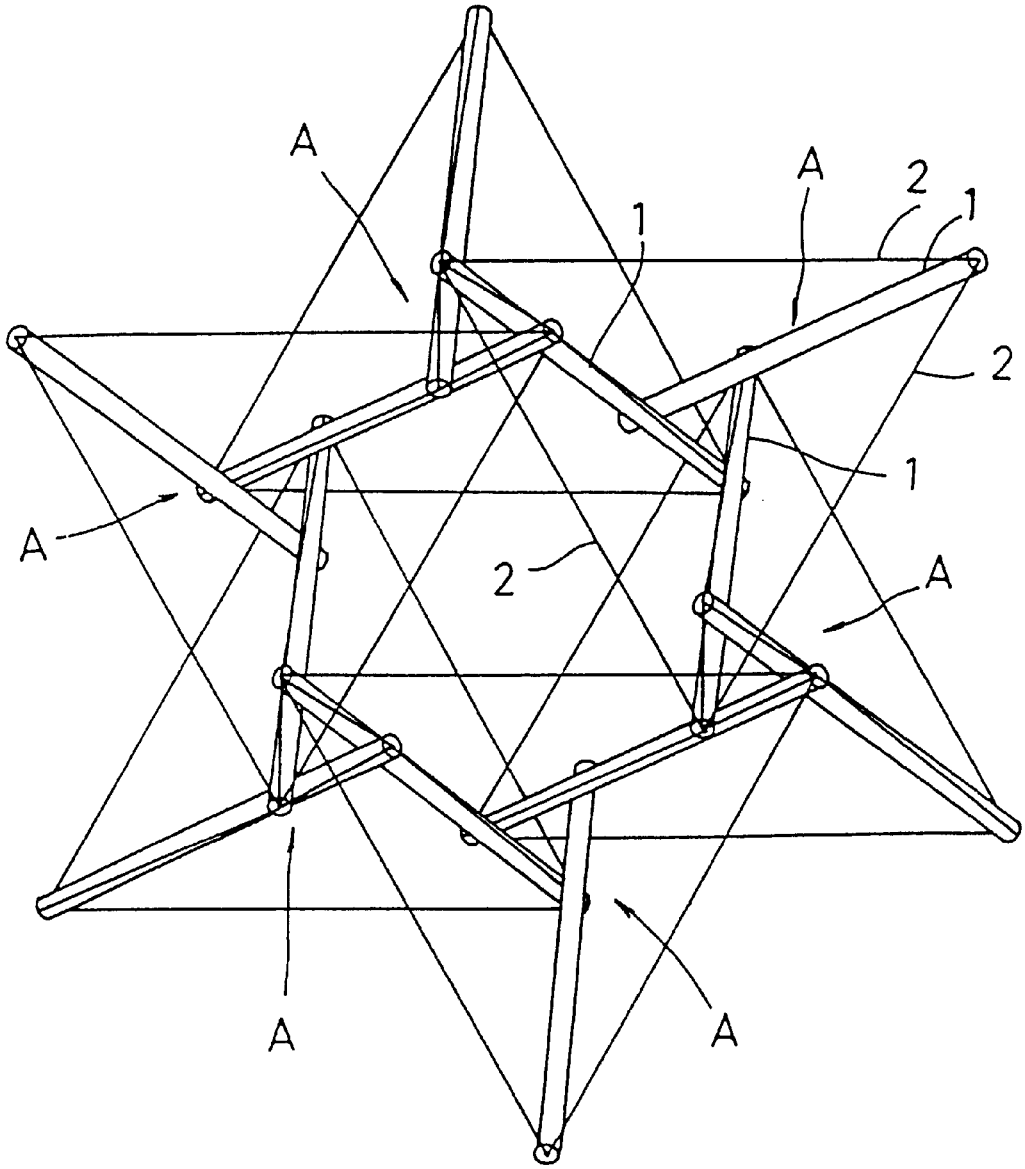
FIG. 2 is a plan view illustrating a linked unit of the present invention.

A framed structure C is formed by continuously disposing a plurality of the base units A, where the continues disposing is performed in such a manner that one of the compression members 1 in each of the base units A is used as one of the compression members 1 in an adjacent base unit A to be continuously disposed, as illustrated in FIG. 2.

Specifically, two of the compression members 1 are disposed in such a manner to intersect the remaining compression member 1, the first tension members 2 are tensioned between the first ends of the compression members 1 to form the first triangular plane 3, the second tension members 4 are respectively tensioned between the second ends of the compression members 1 to form the second triangular plane 5, and the third tension members 6 are respectively tensioned between the first end of each compression member 1 and the second end of one of the remaining compression members 1, as described above.

Figure 3:
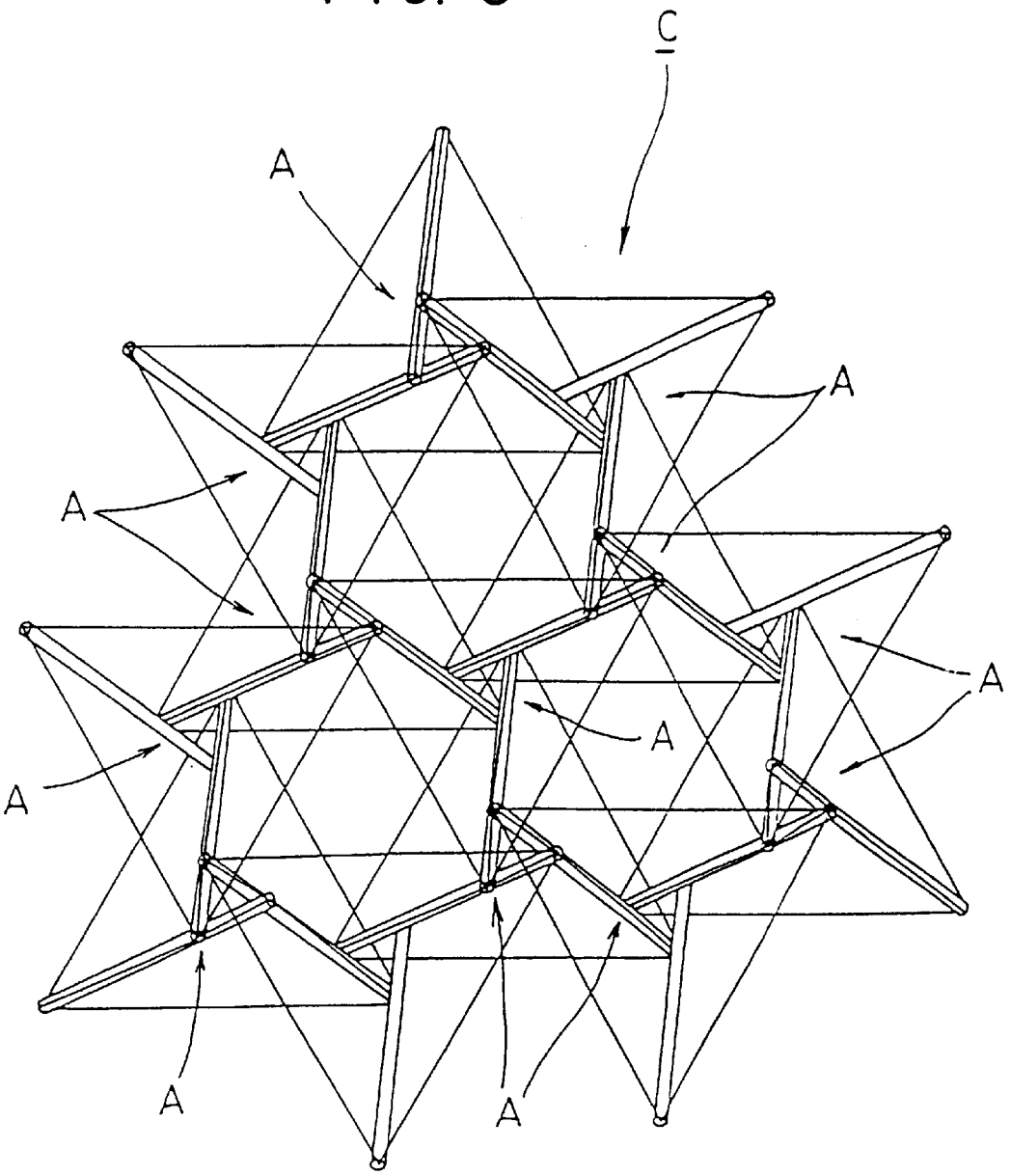
FIG. 3 is a plan view illustrating a framed structure of the present invention.

By continuously disposing the base units A in this manner, the linked unit B of a substantially star shape in plan is formed, which includes six base units A where one of the compression members 1 in each base unit A is used as one of the compression members 1 in an adjacent base unit A. Further, the additional base units A forming this linked unit B are continuously disposed by using one of the compression members 1 in each base unit A as one of the compression members 1 in an adjacent base unit A as described above, thereby forming a framed structure C of a relatively flat shape as illustrated in FIG. 3.

In accordance with the framed structure C of the above arrangement, one of the compression members 1 in each base unit A is used as one of the compression members 1 in an adjacent base unit A to be continuously disposed so that the total number of the compression members 1 can be greatly reduced, and consequently, this arrangement can reduce the total weight of the framed structure, while contributing greatly to the reduction of the cost for the construction.

Second Embodiment

Figure 4:
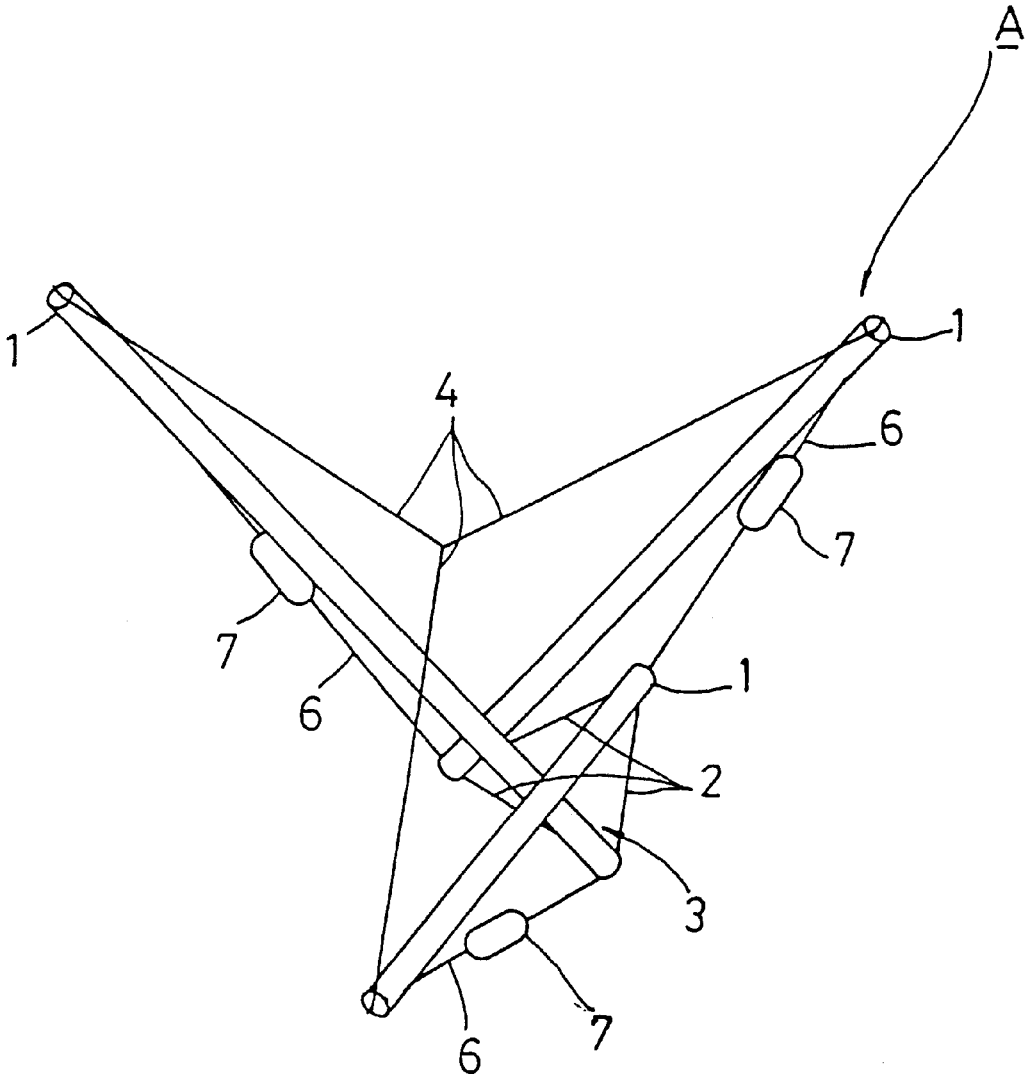
FIG. 4 is a perspective view illustrating the base unit in accordance with another embodiment.
Figure 5:
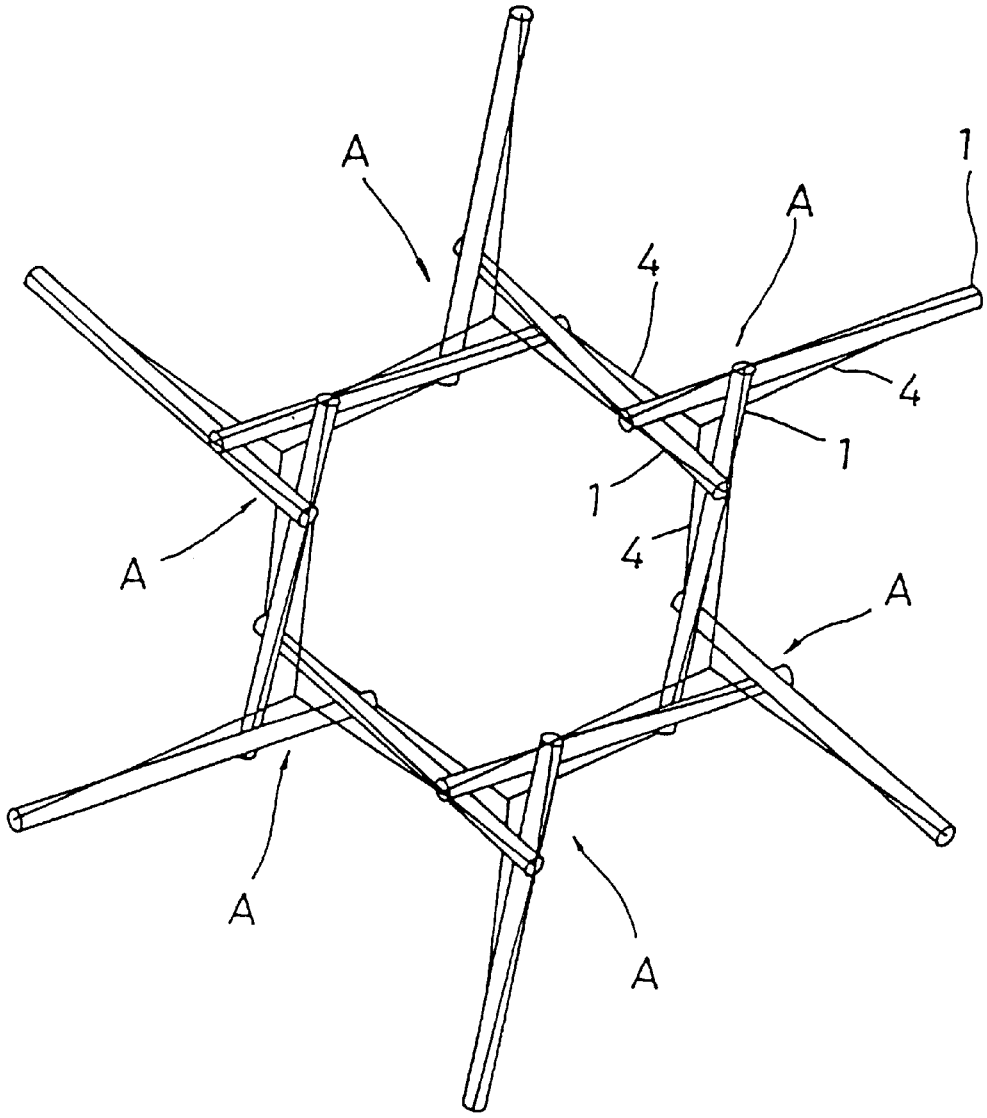
FIG. 5 is a plan view illustrating the linked unit, in which a plurality of the base units of FIG. 4 are continuously disposed.

In the first embodiment, the first tension members 2 and the second tension members 4 are respectively tensioned between the compression members via the first ends and the second ends to form the first triangular plane 3 and the second triangular plane 5 which are positioned opposite to each other. When a plurality of the base units A are continuously disposed to form the framed structure C, each triangular plane 3 lies in the same plane as that of the corresponding one, so that, between the first tension members 2, the second tension members 4, or between the first tension member 2 and the second tension member 4 may overlap each other at their intersecting points, thereby causing errors, or somewhat damage the respective tension members. It will be preferable to employ the following arrangement to eliminate the overlapping portions:

The main features in this embodiment are substantially the same as those in the first embodiment. The different features between these embodiments present in that the second tension members 4 do not form the second triangular plane 5, but are joined together at their one ends, while being respectively interconnected at their other ends to the second ends of the compression members 1, as illustrated in FIGS. 4 and 5. The base units A are continuously disposed in the same manner as in the first embodiment. To join the one ends of the tension members 4 together, a joint member (not shown) may be used at needs.

This arrangement is advantageous in the fact that the elimination of the second triangular plane 5 can avoid the overlapping portions of the second tension members 4. Further, all of the overlapping portions of the first tension members 4 can also be usefully eliminated by joining one ends of the first tension members 4 together, which form the first triangular planes 3, together, as illustrated in FIGS. 6 and 7.

Figure 6:
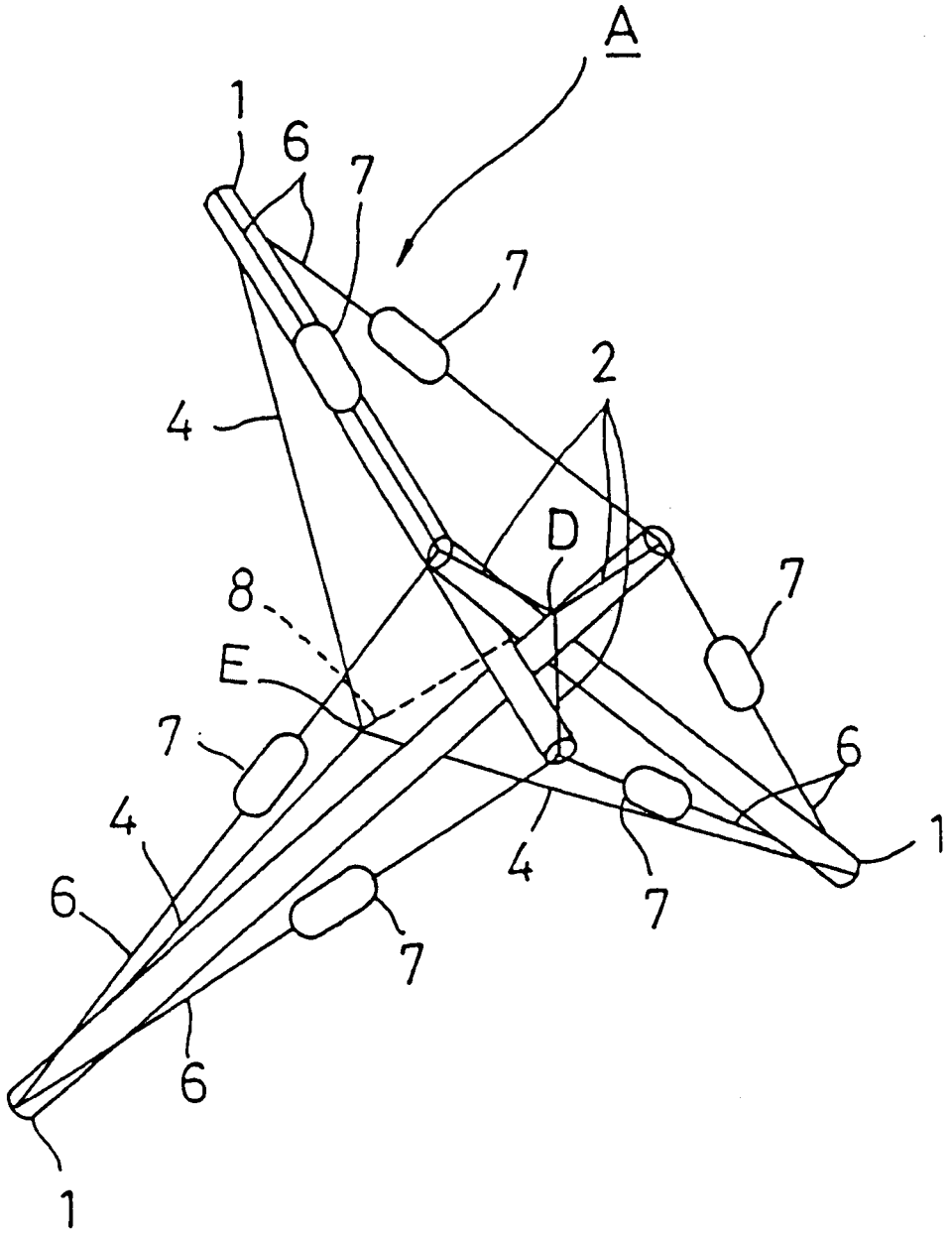
FIG. 6 is a perspective view illustrating the base unit in accordance with another embodiment.
Figure 7:
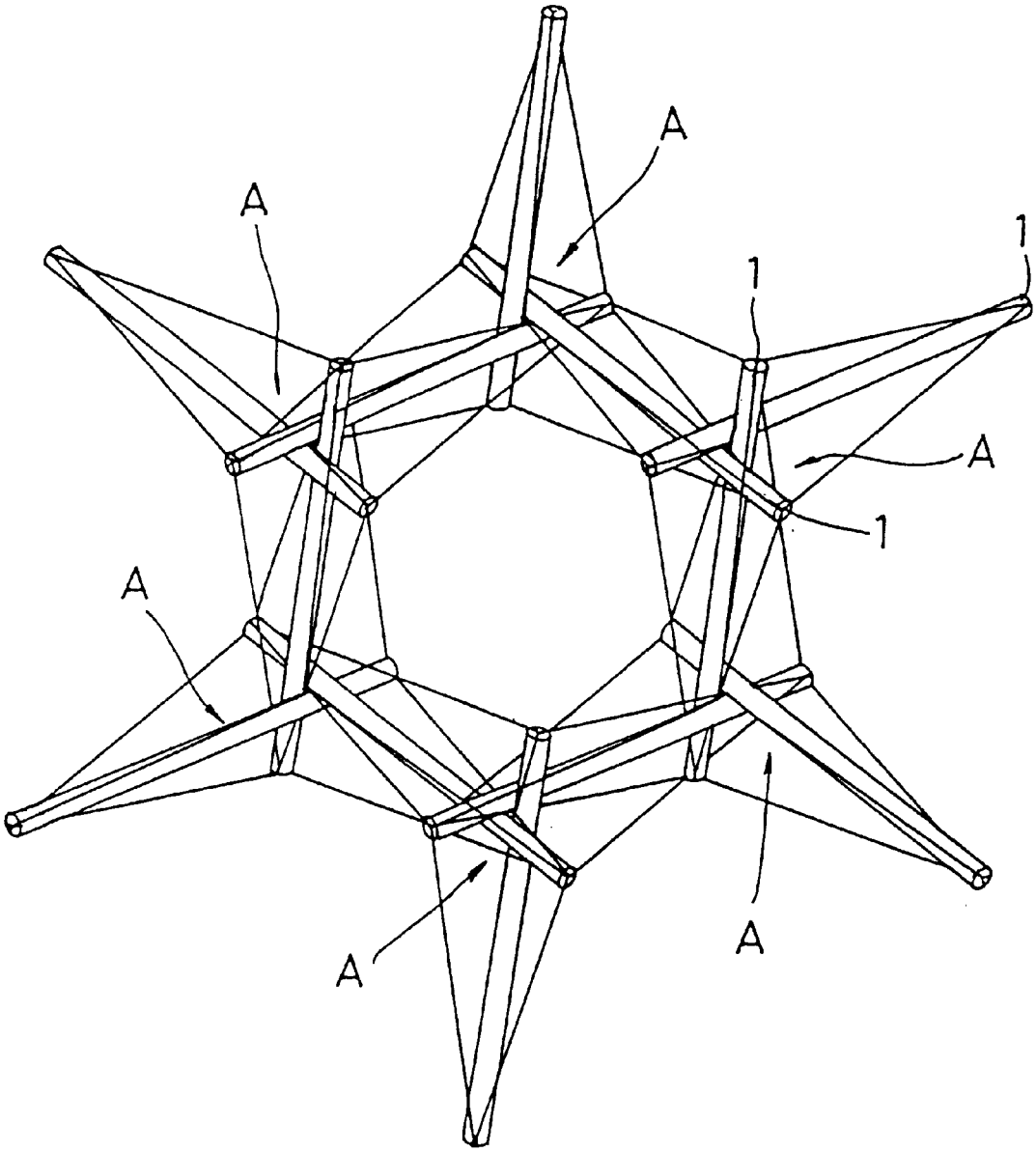
FIG. 7 is a plan view illustrating the linked unit, in which a plurality of the base units of FIG. 6 are continuously disposed.

In this arrangement, by tensioning a fourth tension member 8, which is shown in broken lines in FIG. 6, between joining points D and E, and incorporating a turnbuckle (not shown) into the fourth tension member 8, all of the turnbuckles in the third tension members 6 can be eliminated. As a result, there is an advantage in that the base unit A can structurally be stabilized by using the turnbuckle of the fourth tension member 8 only.

In this embodiment, the third tension members 6 are respectively tensioned between the one end of each compression member and the other ends of the remaining compression members.

Since the framed structure C in accordance with this embodiment has an excellent external appearance, it can function as, for example, an interior decoration.

Third Embodiment

The overlapping portions of the second tension members 4 can also be eliminated by the following arrangement in the same manner as that of the second embodiment.

Figure 8:
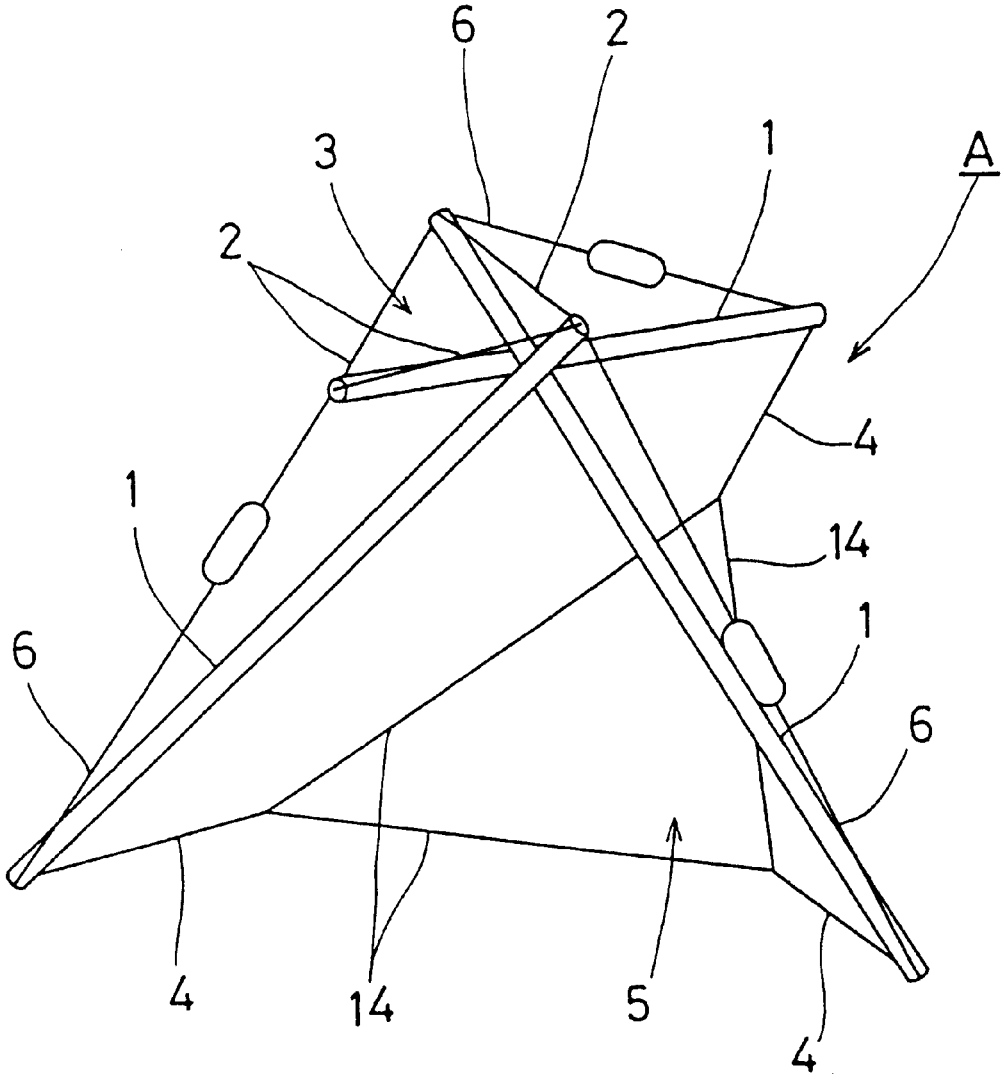
FIG. 8 is a perspective view illustrating the base unit in accordance with another embodiment.
Figure 9:
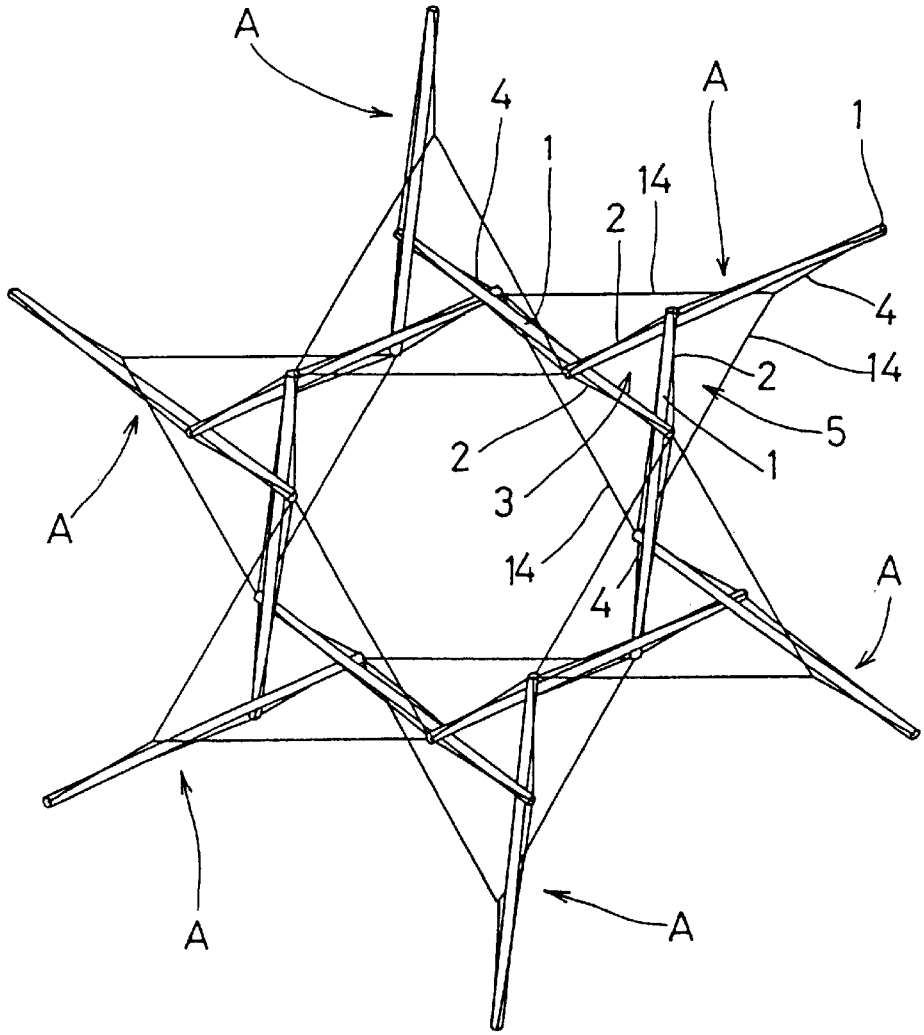
FIG. 9 is a plan view illustrating the linked unit, in which a plurality of the base units of FIG. 8 are continuously disposed.

The basic arrangement in this embodiment is substantially the same as that in the first embodiment, but there are differences in that that the second triangular plane 5 which is opposite to the first triangular plane 3 is formed by seventh tension members 14 to which one ends of the second tension members 4 are joined, as illustrated in FIG. 8, and these second tension members 4 are used as the first tension members 2 of an adjacent base unit A to be continuously disposed at the time of continuously disposing the base units A, as illustrated in FIG. 9.

Whereby, the disadvantage that the first tension members 2 respectively overlap the second tension members 4 can be avoided, with the result that the entire structure can be simplified.

Fourth Embodiment

On the contrary to the above embodiments, in which the base units A each include three compression members 1, the case in which four compression members 1 are used will be described in this embodiment.

Figure 10A:
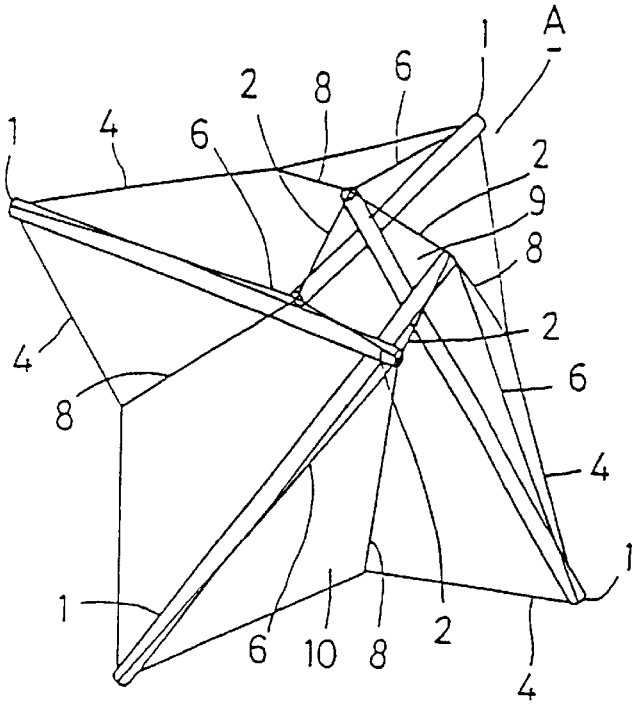
FIG. 10A is a perspective view illustrating the base unit in accordance with another embodiment.

In FIG. 10A, four compression members 1 are disposed in such a manner as to intersect one another, and the first tension members 2 are respectively tensioned between the first ends of the compression members 4 to form a rectangular plane 9. The second tension members 4 are respectively tensioned between the second ends of the compression members 1 to form a plane 10 which is opposite to the first rectangular plane 9. The third tension members 6 are respectively tensioned between the first end of each compression member 1 and the second end of one of the remaining compression members 1. The fourth tension members 8 are respectively interconnected at their one ends to the first ends of the compression members 1, to which the third tension member 6 is joined, while being respectively joined at their other ends to substantial midpoints of the second tension members 4.

Figure 10B:
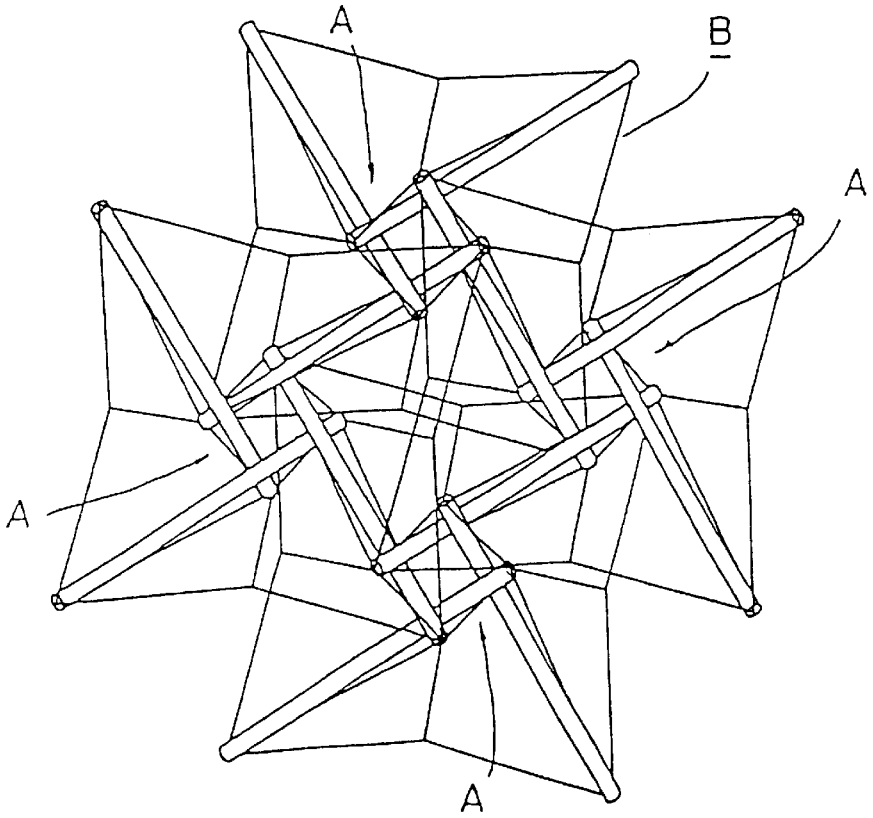
FIG. 10B is a plan view illustrating the linked unit, in which the same base units are continuously disposed.

In FIG. 10B, the base units A are continuously disposed to form the linked unit B in the same manner as that of each embodiment given above, where one of the compression members 1 in each of the base units A is used as one of the compression members 1 in an adjacent base unit A to be continuously disposed. This arrangement also eliminates the overlapping portion between the tension members or between the tension members and the compression members 1.

The means of the third embodiment that three compression members 1 are used is also be applicable to this embodiment.

Figure 11:
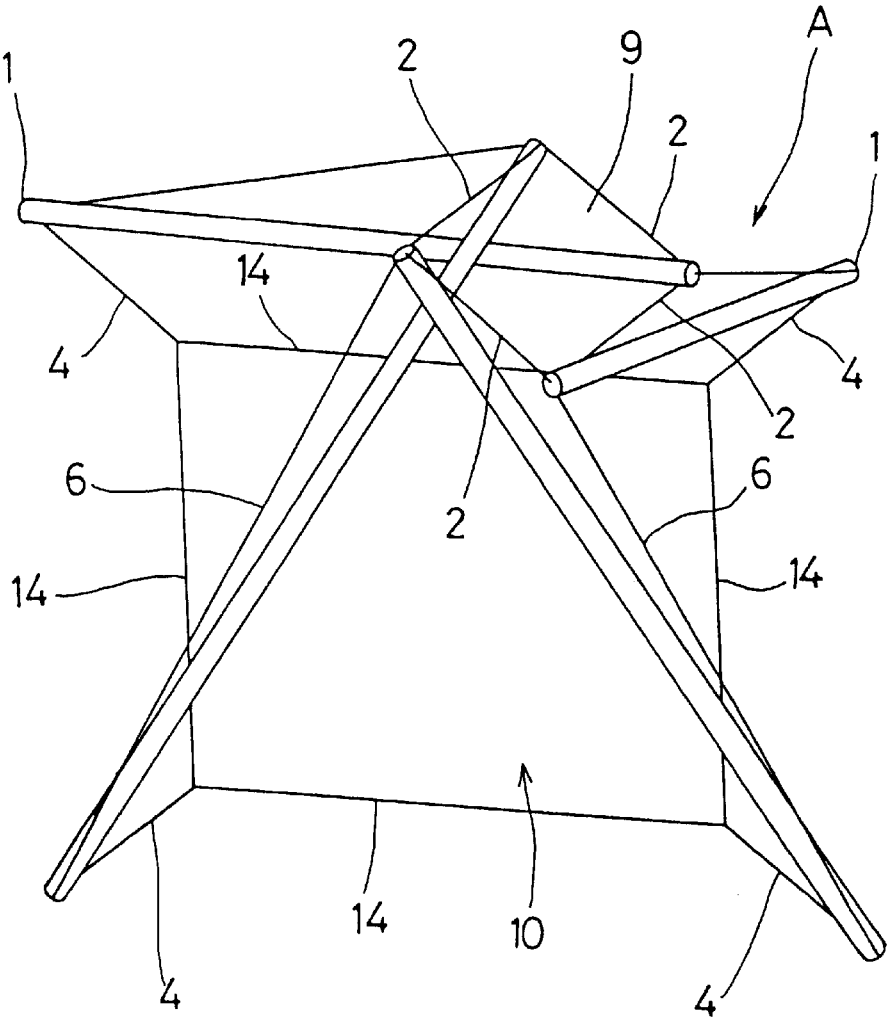
FIG. 11 is a perspective view illustrating the base unit in accordance with another embodiment.

Specifically, as illustrated in FIG. 11, the fourth tension members 8 are omitted and a second rectangular plane 10 which is opposite to the first rectangular plane 9 is formed by seventh tension members 14. Then, the second tension members 4 each having one end joined to the second end of the corresponding compression member 1 each are joined at the other end to the corresponding seventh tension member 14, and the second tension member 4 in each base unit A is used in an adjacent base unit A to be continuously disposed.

Figure 12:
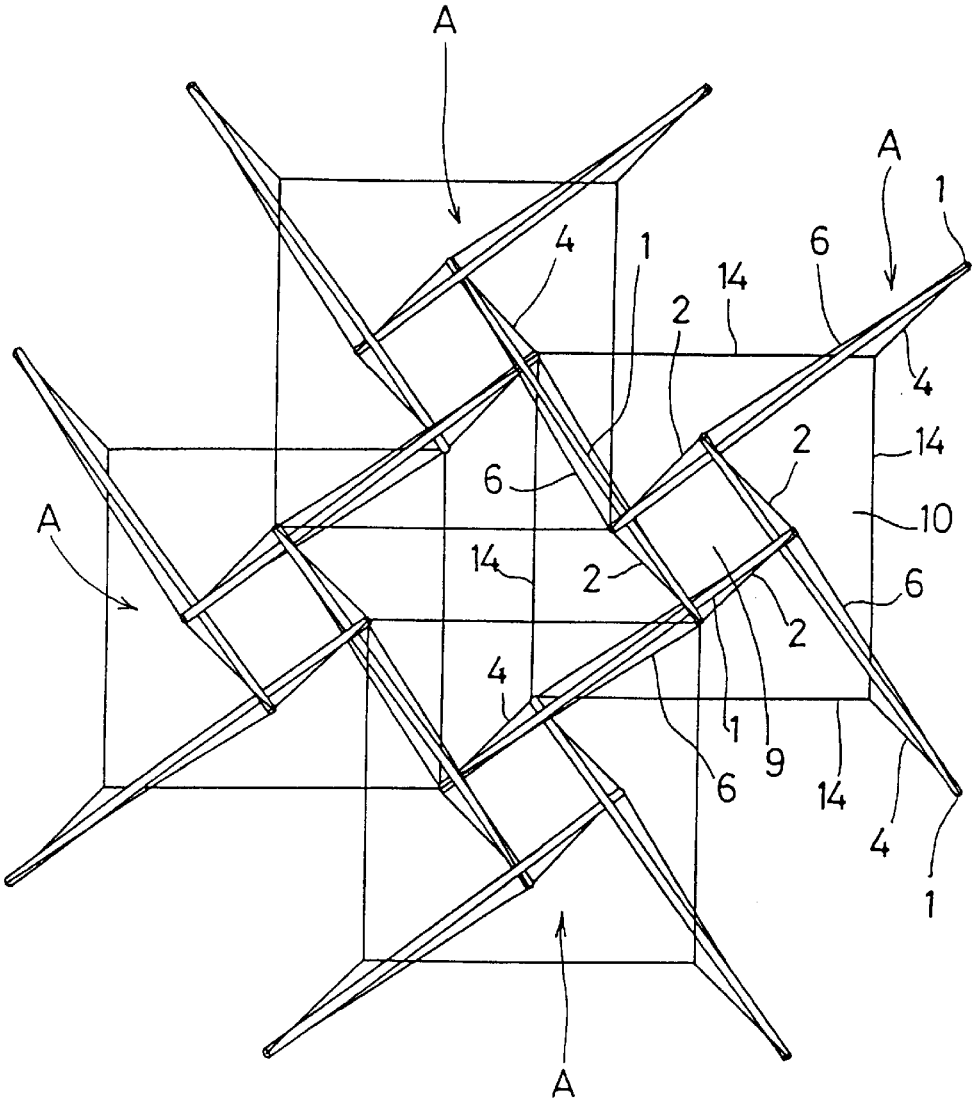
FIG. 12 is a plan view illustrating the linked unit, in which a plurality of the base units of FIG. 11 are continuously disposed.

This arrangement also eliminates the overlapping portion between the first tension members 2 and the second tension members 4, so that the base units A are continuously disposed as illustrated in FIG. 12.

Figure 13A:
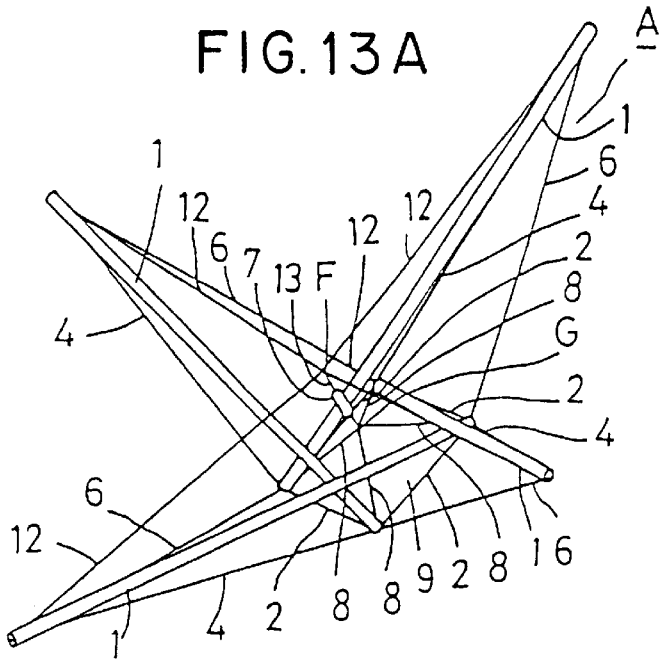
FIG. 13A is a perspective view illustrating the base unit in accordance with another embodiment.

The base unit A is formed as illustrated in FIG. 13A. Specifically, the first tension members 2 are respectively tensioned between the first ends of the compression members 1 in such a manner as to form the first rectangular plane 9. The second tension members 4 are respectively tensioned between the first end of each compression member 1 and the second end of either one of the remaining compression members 1 to which the first tension members 2 are tensioned. The third tension members 6 are respectively tensioned between the first ends of the compression members 1 and the second ends of the compression members 1, to which the first tension members 2 are not tensioned. Accordingly, two tension members, the corresponding second tension member 4 and the third tension member 6 are joined to the second end of each compression member 1. The fourth tension members 8 are respectively interconnected at their one ends to the first ends of the compression members 1, while being joined together at their other ends. Fifth tension members 12 are respectively interconnected at their one ends to the second ends of the compression members 1, while being joined together at their other ends. A sixth tension member 13 is tensioned between a joining point F of the fifth tension members 12 and a joining point G of the fourth tension members 8. In this case, by providing the sixth tension member 13 with the turnbuckle 7, an initial tension force which is applied over the base unit A can advantageously be adjusted, while maintaining symmetry.

Figure 13B:
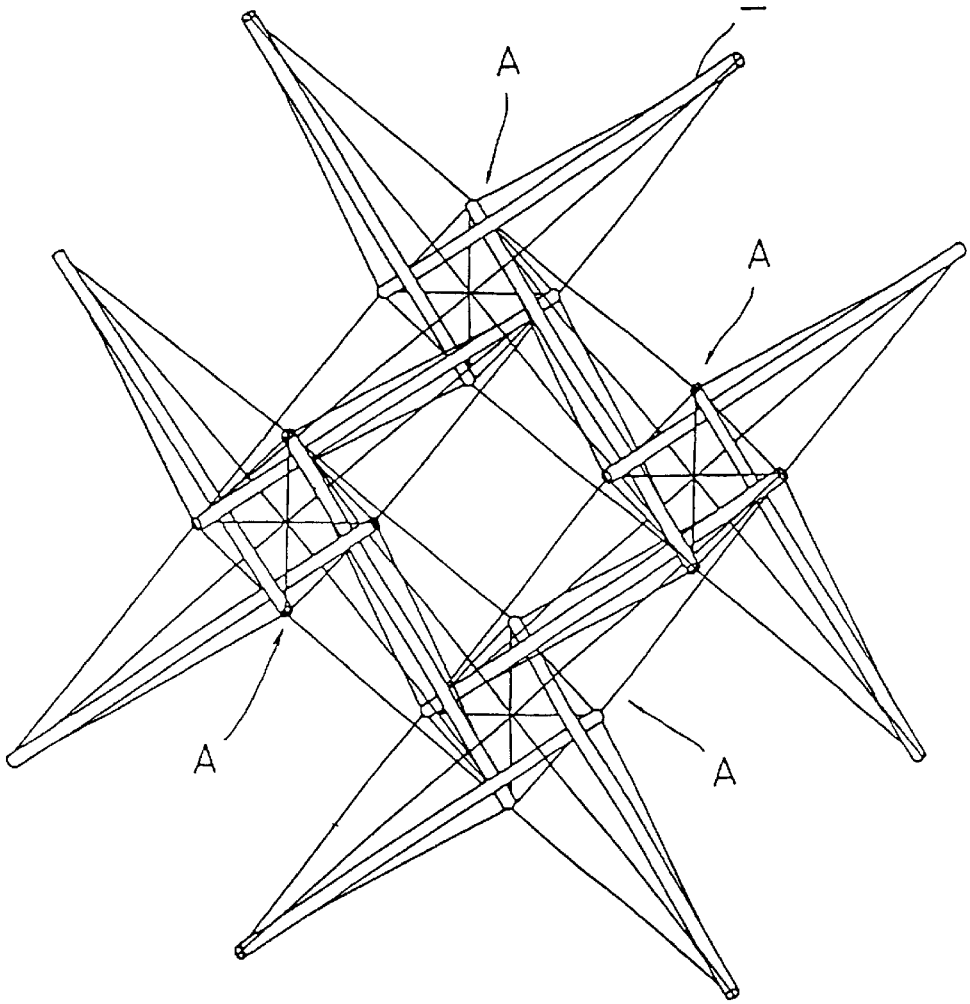
FIG. 13B is a plan view illustrating the linked unit, in which a plurality of the same base units are continuously disposed.

As illustrated in FIG. 13B, the linked unit B is formed by continuously disposing the base units A in the same manner as that in each embodiment given above, where one of the compression members 1 in each of the base units A is used as one of the compression members 1 in an adjacent base unit A.

Thus, the same effects as those in the arrangement, where three compression members 1 are used, can be obtained in the arrangement, where four compression members 1 are used.

Fifth Embodiment

The framed structure C in each embodiment given above is formed in a flat shape. However, it is possible to form the framed structure into a curved surface by properly varying the length of the compression members 1 and value of the tension force applied over the tension members 2, 4, 6.

Next, one embodiment for forming the framed structure C into a curved surface by changing the value of the applied tension force will be described hereinbelow.

Figure 14:
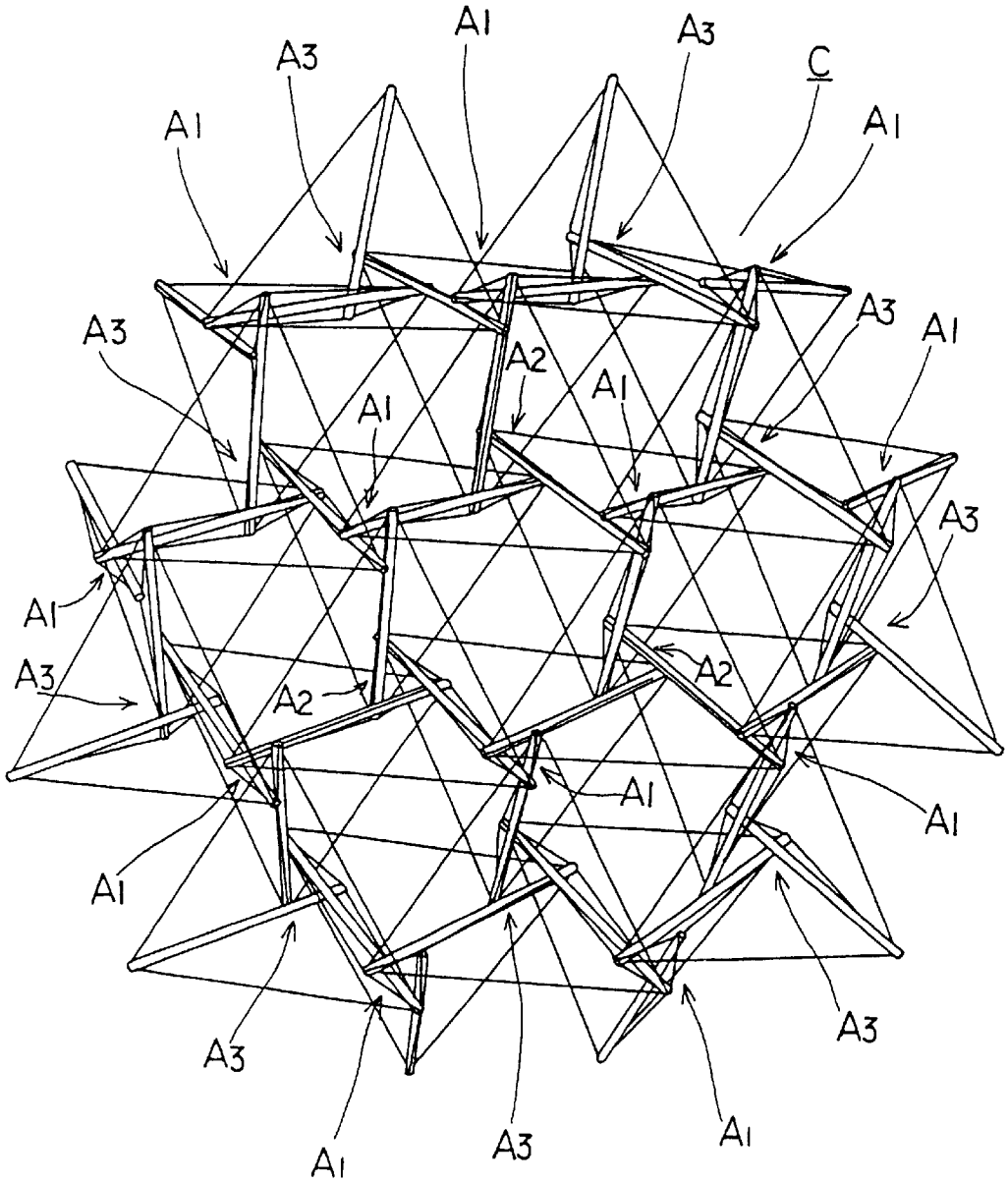
FIG. 14 is a plan view illustrating another embodiment.

The base units A described in the first embodiment are used, and flatly and continuously disposed on a setting surface in the same manner as in the first embodiment as illustrated in FIG. 14, where each of the third tension members 6 has a length slightly longer than the length in a completed shape, and the remaining tension members 2 and 4 are also in a loosened state.

The tension force is applied via the turnbuckles 7 (not shown) of the third tension members 6 in all of the base units A1 which are assembled with their ends upwardly oriented. Thereby, the tension force is applied over the remaining tension members 2 and 4 in the base units A1 so that the framed structure C can structurally be stabilized.

Next, the tension force is successively applied via the turnbuckles 7 of the third tension members 6 in all of base units A2 which are positioned in a center portion of the framed structure C and assembled with their ends downwardly oriented. Thereby, each of the base units A1, A2 which constitute the center portion of the framed structure C is drawn into a tensed state, and tilting angles of the compression members 1 are gradually changed to enable the compression members 1 to be vertically oriented. As a result, the center portion is slightly lifted up into the air.

Figure 15:
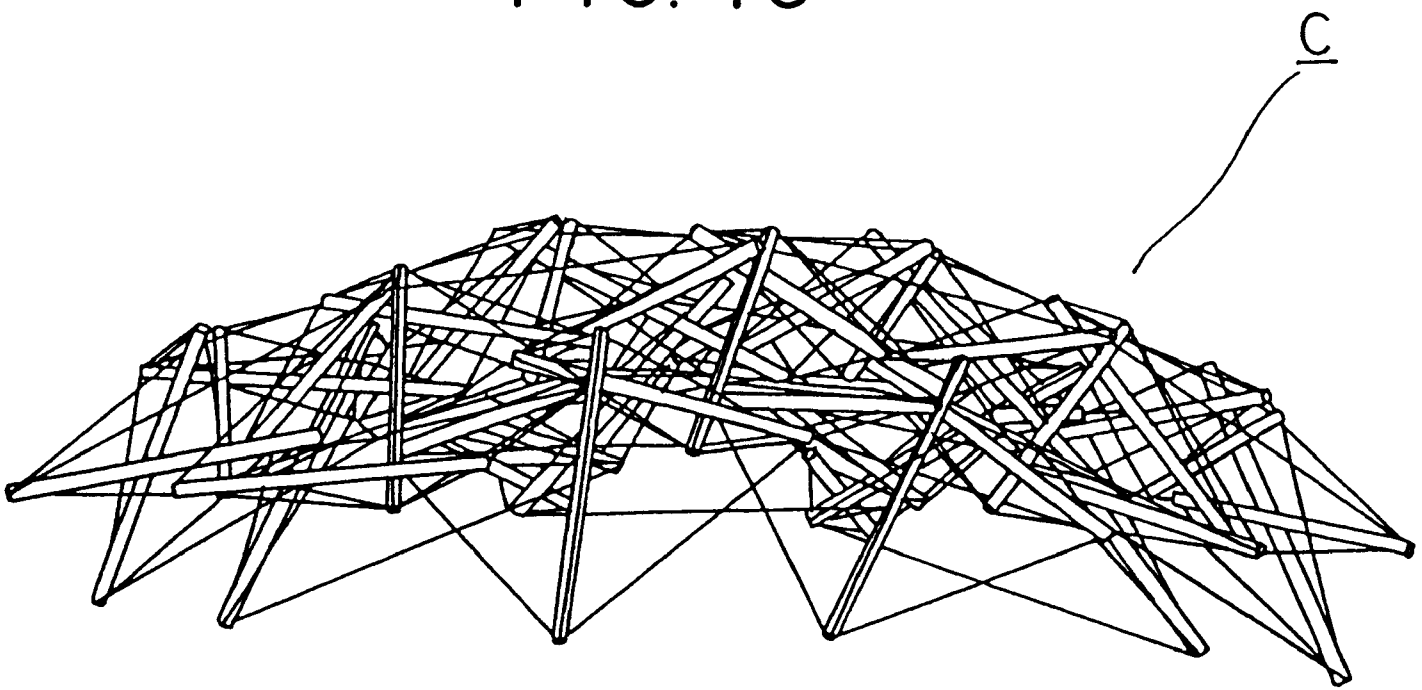
FIG. 15 is a front view illustrating the same embodiment.

Then, the tension force is successively applied via the turnbuckles 7 of the third tension members 6 in base units As which are positioned in a peripheral portion of the framed structure C and assembled with their ends downwardly oriented. Thereby, the base units A1, A2 which are positioned in the center portion are lifted up to a higher level. As a result, the framed structure C of the curved surface is formed, the center portion of which is positioned at a top, as illustrated in FIG. 15.

Accordingly, by firstly applying the tension force via the third tension members 6 of the base units A2 in the center portion, a series of works from the continuous disposing of the base units A to the application of the tension force can be performed on a ground level. This eliminates the necessity to separately establish a scaffold so that a series of the works can be performed in simple and effective manner.

By applying the tension force over the third tension members 6, the base units A1 can be lifted up to be positioned in the air so that a so-called lift-up apparatus including a crane, jack and the like can be omitted.

In this case, by providing rolling members such as rollers at lower ends of the compression members 1, the compression members 1 can smoothly be moved on the setting surface at the time of the application of the tension force. This contributes to a working efficiency.

In said embodiment, the turnbuckles 7 are respectively provided in the third tension members 6. However, it is possible to provide them in the other tension members 2 and 4, or all of the tension members 2, 4 and 6.

Further, it is not necessary to limit the order to apply the tension force via the turnbuckles 7 to that described in the above embodiment.

Further, it is not necessary to limit the base unit A to that of the first embodiment. It is possible to use the base unit A of the second embodiment or later.

In the above embodiments, a plurality of the tension members are interconnected between the respective ends of the compression members 1. However, it is possible that a single tension member can be tensioned therebetween. It is essential that each of the tension members is secured to each end.

It is not necessary to limit an application of the framed structure C to a framework used for a roofing material or the like of a building. It doesn't matter what a specific use is.

A specific arrangement of the first to seventh tension members 2, 4, 6, 8, 12, 13 and 14, as well as their connecting means or the like can be optionally varied within the intended scope of the present invention.

What is claimed is:

1. A framed structure comprising a plurality of base units each including three elongate compression members disposed so as to intersect one another, each having a first end and a second end; a first tension member disposed to be tensioned between the first ends of the respective compression members in such a manner as to form a first triangular plane; a second tension member disposed so as to be tensioned between the second ends of the respective compression members in such a manner as to form a second triangular plane opposite to the first triangular plane; and a third tension member disposed so as to be tensioned between the first end of one of the compression members and the second end of one of the remaining compression members in such a manner as to form a self-supporting structure, wherein said plurality of the base units are continuously disposed by using one of the compression members in one of the base units as one of the compression members in an adjacent base unit.

2. A framed structure comprising a plurality of base units each including three elongate compression members disposed so as to intersect one another, each having a first end and a second end; a first tension member disposed to be tensioned between the first ends of the respective compression members in such a manner as to form a first triangular plane; plural second tension members, each second tension member being disposed to be interconnected at one end thereof to the second ends of the respective compression members, said plural second tension members being connected together at the other ends thereof; and a third tension member disposed so as to be tensioned between the first end of one of the compression members and the second end of one of the remaining compression members in such a manner as to form a self-supporting structure, wherein said plurality of the base units are continuously disposed by using one of the compression members in one of the base units as the compression member in an adjacent base unit.

3. A framed structure as set forth in claim 2, wherein the second tension members connected together at the respective other ends are connected to a further tension member forming a second triangular plane which is opposite to the first triangular plane, and the further tension member is arranged as the first tension member of an adjacent base unit.

4. A framed structure characterized by comprising a plurality of base units each including three elongate compression members disposed so as to intersect one another, each having a first end and a second end; plural first tension members, each first tension member being disposed so as to be interconnected at one end thereof to the first ends of the respective compression members, said plural first tension members being connected together at the other ends thereof; plural second tension members, each second tension member being disposed so as to be interconnected at one end thereof to the second ends of the respective compression members, said plural second tension members being connected together at the other ends thereof; and a third tension member disposed between the first end of one of the compression members and the second end of one of the remaining compression members, wherein said plurality of the base units are continuously disposed having one of the compression members in one of the base units be one of the compression members in an adjacent base unit.

5. A framed structure as set forth in claim 4, wherein a turnbuckle is provided in the third tension member.

6. A framed structure as set forth in claim 4, wherein a fourth tension member for applying tension force is tensioned between a joining point of the first tension member and a joining point of the second tension member.

7. A framed structure comprising a plurality of base units each including four elongate compression members disposed so as to intersect one another, each having a first end and a second end; a first tension member disposed to be tensioned between the first ends of the respective compression members in such a manner as to form a rectangular plane; a second tension member disposed so as to be tensioned between the second ends of the respective compression members in such a manner as to form a plane opposite to the rectangular plane; a third tension member disposed so as to be tensioned between the first end of one of the compression members and the second end of one of the remaining compression members in such a manner as to form a self-supporting structure, and a fourth tension member disposed so as to be tensioned between the first ends of the respective compression members and the second tension member, wherein said plurality of the base units are continuously disposed having one of the compression members in one of the base units be one of the compression members in an adjacent base unit.

8. A framed structure comprising a plurality of base units each including four elongate compression members disposed so as to intersect one another, each having a first end and a second end; a first tension member disposed to be tensioned between the first ends of the respective compression members in such a manner as to form a first rectangular plane; a further tension member for forming a second rectangular plane opposite to the first rectangular plane; plural second tension members, each second tension member being disposed so as to be interconnected at one end thereof to the second ends of the respective compression members, said plural second tension members being connected together at the other ends thereof to the further tension member; and a third tension member disposed so as to be tensioned between the first end of one of the compression members and the second end of one of the remaining compression members in such a manner as to form a self-supporting structure, wherein said plurality of the base units are continuously disposed having one of the compression members in one of the base units be one of the compression members in an adjacent base unit, and having the second tension member be the first tension member in an adjacent base unit to be continuously disposed.

9. A framed structure comprising a plurality of base units each including four elongate compression members disposed so as to intersect one another, each having a first end and a second end; a first tension member disposed so as to be tensioned between the first ends of the respective compression members in such a manner as to form a first rectangular plane; plural second tension members, each second tension member being disposed so as to be tensioned between the second end of one compression member and the first end of one of the adjacent compression members in the first rectangular plane; plural third tension members, each third tension member being disposed so as to be tensioned between the second end of the one compression member and the first end of the other adjacent compression member in the first rectangular plane; plural fourth tension members, each fourth tension member being disposed so as to be interconnected at one end thereof to the first end of the respective compression members, said fourth tension members being connected together at the other ends thereof at a first joining point; plural fifth tension members, each fifth tension member being disposed so as to be interconnected at one end thereof to the second end of the respective compression members, said fifth tension members being connected together at the other ends thereof at a second joining point; wherein the second tension members and the third tension members are connected to the second ends of the respective compression members, and a sixth tension member for applying tension force is disposed so as to be tensioned between the second joining point of the fifth tension members and the first joining point of the fourth tension members, and said plurality of the base units are continuously disposed having one of the compression members in one of the base units be one of the compression members in an adjacent base unit.

10. A framed structure as set forth in claim 9, wherein a turnbuckle is provided in the sixth tension member.

11. A framed structure as set forth in any one of claims 1, 2, 4, 7, 8, or 9, wherein the base units are continuously disposed in a curved surface.

12. A method of constructing a framed structure comprising continuously disposing a plurality of base units, each of which includes three elongate compression members disposed so as to intersect one another, each having a first end and a second end, a first tension member disposed to be tensioned between the first ends of the respective compression members in such a manner as to form a first triangular plane, a second tension member disposed so as to be tensioned between the second ends of the respective compression members in such a manner as to form a second triangular plane opposite to the first triangular plane, and a third tension member disposed so as to be tensioned between the first end of one of the compression members and the second end of one of the remaining compression members in such a manner as to form a self-supporting structure, having one of the compression members in one of the base units be one of the compression members in an adjacent base unit; and applying tension force over at least one of said first, second, and third tension members in such a manner as to change the shape of each of the base unit, thereby forming the framed structure into a curved surface.

13. A method of constructing a framed structure comprising continuously disposing a plurality of base units each including four elongate compression members disposed so as to intersect one another, each having a first end and a second end, a first tension member disposed to be tensioned between the first ends of respective compression members in such a manner as to form a rectangular plane, a second tension member disposed so as to be tensioned between the second ends of respective compression members in such a manner as to form a plane opposite to the rectangular plane, a third tension member disposed so as to be tensioned between the first end of one of the compression members and the second end of one of the remaining compression members in such a manner as to form a self-supporting structure, and a fourth tension member disposed so as to be tensioned between the first ends of respective compression members and the first tension member, having one of the compression members in one of the base units be one of the compression members in an adjacent base unit, and applying tension force over at least one of said first, second, third, and fourth tension members in such a manner as to change the shape of each of the base unit, thereby forming the framed structure into a curved surface.

* * * * *